United States Patent [19]

Matsumoto et al.

[11] Patent Number: 4,898,489

[45] Date of Patent: Feb. 6, 1990

[54] PAPER SUPPORT MECHANISM IN A PRINTER

[75] Inventors: Junichiro Matsumoto; Mitsuhiro Shimada; Yoichi Yamamoto, all of Nara, Japan

[73] Assignee: Sharp Kabushiki Kaisha, Osaka, Japan

[21] Appl. No.: 643,470

[22] Filed: Aug. 23, 1984

[30] Foreign Application Priority Data

Aug. 26, 1983 [JP] Japan ..... 58-156749

[51] Int. Cl.[4] ..... B41J 11/08

[52] U.S. Cl. ..... 400/656; 400/120; 400/561; 400/643; 400/662

[58] Field of Search ..... 400/635, 644, 561, 610, 400/629, 643, 656, 657, 648, 658, 654, 120, 662; 271/198, 199, 200, 201

[56] References Cited

U.S. PATENT DOCUMENTS

| | | | |
|---|---|---|---|
| 1,110,464 | 9/1914 | Smith | 400/629 X |
| 1,180,388 | 4/1916 | Freeman | 400/648 X |
| 2,912,091 | 11/1959 | Gemmel | 400/648 |
| 4,314,696 | 2/1982 | Graef | 271/198 X |
| 4,327,366 | 4/1982 | Schafter et al. | 400/120 X |

FOREIGN PATENT DOCUMENTS

| | | | |
|---|---|---|---|
| 112007 | 10/1968 | Denmark | 271/200 |
| 0038176 | 10/1981 | European Pat. Off. | 400/635 |
| 2031460 | 4/1978 | Fed. Rep. of Germany | 400/656 |
| 118883 | 9/1981 | Japan | 400/656 |
| 137982 | 10/1981 | Japan | 400/656 |

OTHER PUBLICATIONS

IBM Tech. Disc. Bulletin, "Print Belt/Exit Belt Transfer Mechanism", Gravell et al., vol. 18, No. 6, Nov. 1975, pp. 1673–1674.

IBM Tech. Disc. Bulletin, "Improved Friction in Drive Belts", Bradley et al., vol. 19, No. 10, Mar. 1977, p. 3677.

IBM Tech. Disc. Bulletin, "Tensioning System for Photoconductor Belt", Curran et al., vol. 24, No. 10, Mar. 1982, pp. 5019–5020.

*Primary Examiner*—William Pieprz
*Assistant Examiner*—James R. McDaniel
*Attorney, Agent, or Firm*—Birch, Stewart, Kolasch & Birch

[57] ABSTRACT

A printer system containing an elastic endless sheet member which extends between roller members in front of a print head. The roller members are disposed so as to form a flat surface of the elastic endless sheet member in front of the print head in order to ensure clean printing. One of the roller members is connected to a paper feed motor so that a paper sheet is fed in front of the print head in the vertical direction in unison with the rotation of the elastic endless sheet member around the roller members.

8 Claims, 2 Drawing Sheets

PAPER SUPPORT MECHANISM IN A PRINTER

BACKGROUND OF THE INVENTION

1. Field of the Invention

The present invention relates to a paper support mechanism in a printer such as a thermal printer, ink jet printer and impact printer.

2. Description of the Prior Art

Two types of mechanism are conventionally used to support paper in a printer system. One type employs a stationary flat plate disposed at the back of the paper, and in front of a print head. The stationary flat plate has an elastic flat surface which contacts the rear surface of the paper. The elastic flat surface is effective to ensure clean printing. However, the elastic flat plate functions to increase the load when the paper is fed in front of the print head after completion of one line printing. Another type of mechanism employs a cylinder shaped platen for supporting and feeding the paper in front of the print head. When the curvature of the platen is small, the load is minimized in the paper feeding operation. however, a clean printing is not ensured because the print head can not contact the paper in a desired area. If the curvature of the platen is large, the load becomes high when the paper feeding operation is conducted.

OBJECTS AND SUMMARY OF THE INVENTION

OBJECTS OF THE INVENTION

Accordingly, an object of the present invention is to provide a novel paper support mechanism in a printer system.

another object of the present invention is to provide a paper support/feeding mechanism in a printer, which ensures a clean printing and smooth paper feeding operation.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

SUMMARY OF THE INVENTION

To achieve the above objects, pursuant to an embodiment of the present invention, an endless elastic sheet member is extended among a plurality of roller members. Two roller members are disposed in front of a print head in a parallel fashion so as to form a flat surface of the endless elastic sheet member confronting the print head. One of the roller members is connected to a drive mechanism so that the paper is fed in unison with the movement of the endless elastic sheet member.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
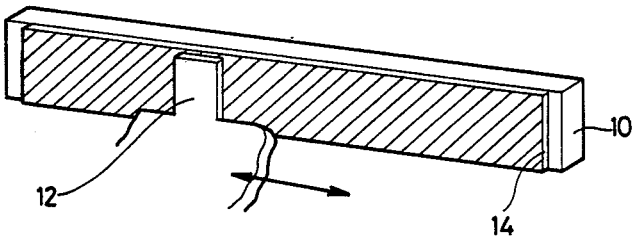
FIG. 1 is a schematic perspective view of an essential part of an example of the paper feed/support mechanism of the prior art.
Figure 2:
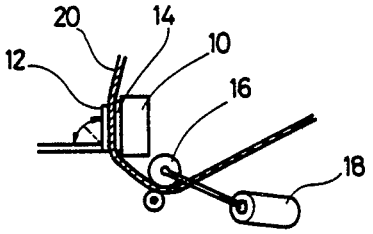
FIG. 2 is a schematic sectional view of the paper feed/support mechanism of FIG. 1.

FIGS. 1 and 2 show an example of the paper feed/-support mechanism of the prior art. A stationary flat plate 10 is disposed in front of a print head 12 in a fashion to parallel the course of the movement of the print head 12. An elastic sheet 14 is attached to the stationary flat plate 10 to ensure clean printing. A paper feed roller 16 is connected to a paper feed motor 18 so as to supply paper 20 between the print head 12 and the elastic sheet 14. The print head 12 can be a thermal print head which is driven to travel in the line direction to conduct the print operation. The thermal print head contacts the paper 20 while the actual printing operation is conducted, and the thermal print head is separated from the paper 20 while the paper 20 is vertically fed by a desired length. In a preferred form, the thermal print head is returned to the home position during the paper feed operation.

the load created during the paper feed operation is considerably high because the paper 20 must move while maintaining the contacting condition between the paper 20 and the elastic sheet 14, which is held stationary.

Figure 3:
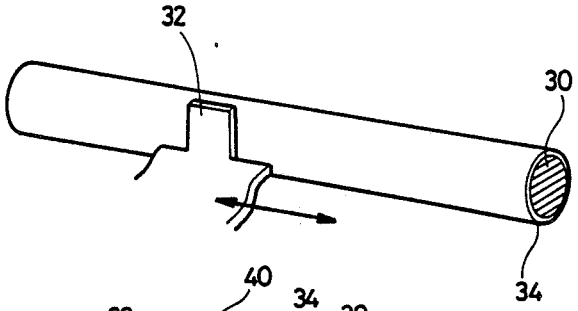
FIG. 3 is a schematic perspective view of an essential part of another example of the paper feed/support mechanism of the prior art.
Figure 4:
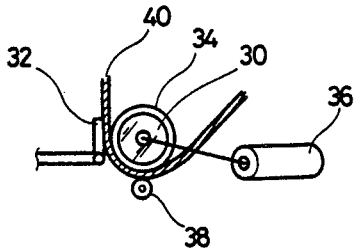
FIG. 4 is a schematic sectional view of the paper feed/support mechanism of FIG. 3.

FIGS. 3 and 4 show another example of the paper feed/support mechanism of the prior art. A cylinder shaped rotatable platen 30 is disposed in front of a print head 32 in a fashion to parallel the course of the movement of the print head 32. An elastic sheet 34 is secured to the surface of the cylinder shaped rotatable platen 30 so as to ensure clean printing. The platen 30 is connected to a paper feed motor 36. A pinch roller 38 is disposed around the platen 30 so that paper 40 is supported around the platen 30, and the paper 40 is vertically fed when the platen 30 is driven to rotate by the paper feed motor 36. That is, the paper 40 moves around the platen 30 in unison with the rotation of the platen 30.

When the curvature of the platen 30 is small, the load is minimized during the paper feed operation. However, a clean printing is not ensured because the print head 32 can not contact the paper 40 in a desired area. When the curvature of the platen 30 is selected large to ensure a clean printing, the load for driving the platen 30 becomes large, and the printer system becomes large.

Figure 5:
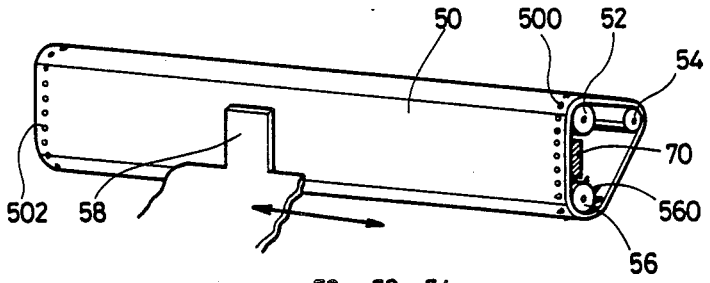
FIG. 5 is a perspective view of an embodiment of a paper feed/support mechanism of the present invention.
Figure 6:
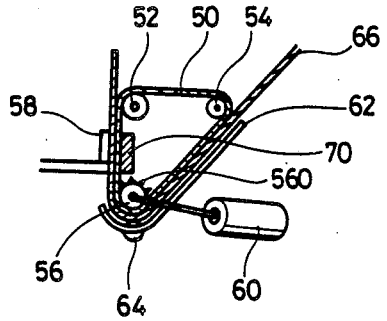
FIG. 6 is a sectional view of the paper feed/support mechanism of FIG. 5.

FIGS. 5 and 6 show an embodiment of a paper feed/-support mechanism of the present invention. An elastic sheet member 50 of endless construction is extended between rollers 52 and 54 and a sprocket wheel roller 56. The roller 52 and the sprocket wheel roller 56 are disposed in front of a print head 58 so as to form a flat surface of the elastic sheet member 50 along the travelling course of the print head 58. The roller 52 and the sprocket wheel roller 56 are spaced from each other so that the flat surface has a height sufficient to ensure a clean printing. Sprocket wheels 560 are secured to both ends of the sprocket wheel roller 56, and perforations 500 and 502 are formed along the both edges of the elastic sheet member 50 so as to transfer the rotation of the sprocket wheel roller 56 to the elastic sheet member 50. The sprocket wheel roller 56 is connected to a paper feed motor 60 so as to rotate the elastic sheet member 50 around the sprocket wheel roller 56 and the rollers 52 and 54. A paper guide plate 62 and a pinch roller 64 are disposed at desired positions so as to ensure the supply of the paper 66 around the elastic sheet member 50.

Figure 7:
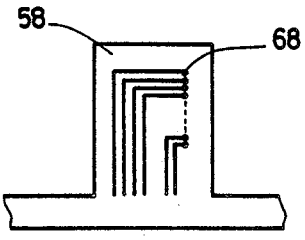
FIG. 7 is a front view of a print head associated with the paper feed/support mechanism of FIG. 5.

The print head 58 can be a thermal print head as shown in FIG. 7. The thermal print head includes a plurality of heating elements 68 aligned in the vertical direction. The actual printing operation is conducted when the heating elements 68 contact the paper 66, and the print head 58 travels in front of the elastic sheet member 50 in the horizontal, line direction. A rear support plate 70 is disposed at the back of the elastic sheet member 50 where the print head 58 contacts the paper 66. As already discussed, the elastic sheet member 50 is disposed in front of the print head 58 in a manner that the elastic sheet member 50 has the flat surface of which height in the vertical direction is greater than the total height of the heating elements 68 aligned on the surface of the print head 58.

The outer surface of the elastic sheet member 50 is made of a material having a considerably high coefficient of friction so as to ensure paper feeding operation. That is, the paper 66 is fed in unison with the movement (rotation) of the elastic sheet member 50. The inner surface of the elastic sheet member 50 is made of a material having a low coefficient of friction, for example, teflon resin. Further, the surfaces of the rollers 52, 54 and 56 are coated with a material having a low coefficient of friction, for example, teflon resin.

The distance between the roller 52 and the sprocket wheel roller 56 determines the height of the flat surface formed by the elastic sheet member 50. If another print head of different size is used, the distance between the roller 52 and the sprocket wheel roller 56 is adjusted to ensure clean printing.

the invention being thus described, it will be obvious that the same may be varied in many ways. Such variations are not to be regarded as a departure from the spirit and scope of the invention, and all such modifications are intended to be included within the scope of the following claims.

What is claimed is:

1. A paper feed/support mechanism for a printer which has a thermal print head adapted to travel in a horizontal plane, said print head containing a plurality of heating elements which are aligned in a direction extending substantially perpendicular to the direction of travel of the print head which comprises:

an endless elastic sheet member having a width extending over a printing zone of said printer;

at least two roller members forming a conveying surface for extending said endless sheet member in front of said print head, said at least two roller members including a pair of rollers which form, in combination, a flat conveying surface in front of said print head, said flat surface having a height, measured in the direction perpendicular to the direction of travel of the print head, greater than the height of the heating elements of said print head; and a drive mechanism connected to at least one of said at least two roller members so as to rotate said endless sheet member around said at least two roller members in a plane substantially perpendicular to the traveling direction of the print head.

2. The paper feed/support mechanism of claim 1, wherein said endless sheet member has an outer surface with a coefficient of friction which is higher than that of the inner surface thereof.

3. The paper feed/support mechanism of claim 1, wherein a rear support plate is disposed behind said elastic sheet member along said printing zone.

4. A paper feed/support mechanism for a printer which has a thermal print head adapted to travel in a horizontal plane, said print head containing a plurality of heating elements which are aligned in a direction extending substantially perpendicular to the direction of travel of the print head which comprises:

a first roller disposed along said horizontal plane;

a second roller disposed along said horizontal plane with a predetermined distance between said first roller;

a third roller extending a distance from said first and second rollers said first and second rollers defining, in combination, a conveying flat surface in front of said print head;

an elastic sheet member adapted to be conveyed on said first, second and third rollers, said elastic sheet member forming a flat surface which is adapted to move perpendicular to the direction of travel of the print head; and a driver motor connected to one of said first, second and third rollers so as to rotate said elastic sheet member around said first, second and third rollers, wherein the height of the flat surface extending between said first and second rollers is greater than the height of the heating elements in the print head.

5. The printer of claim 4, wherein one of said first, second and third rollers connected to said driver motor includes:

a roller; and sprocket wheels secured to both ends of said roller; wherein said elastic sheet member is provided with perforations formed along both peripheral edges of said elastic sheet member at positions for engagement with said sprocket wheels.

6. The paper feed/support mechanism of claim 5; wherein said elastic sheet member has an outer surface with a coefficient of friction which is higher than that of the inner surface thereof.

7. The paper feed/support mechanism of claim 5, wherein a rear support plate is disposed behind said elastic sheet member along said printing zone.

8. The paper feed/support mechanism of claim 4, wherein said elastic sheet member has an outer surface with a coefficient of friction which is higher than that of the inner surface thereof.

* * * * *